US009381526B2

(12) United States Patent
Kraft et al.

(10) Patent No.: US 9,381,526 B2
(45) Date of Patent: Jul. 5, 2016

(54) NOZZLE HEAD FOR APPLYING AN INSULATING MATERIAL

(75) Inventors: Bernd Kraft, Steinheim-Höpfigheim (DE); Martin Stiegler, Beilstein (DE)

(73) Assignee: Durr Systems GmbH, Bietigheim-Bissingen (DE)

( * ) Notice: Subject to any disclaimer, the term of this patent is extended or adjusted under 35 U.S.C. 154(b) by 350 days.

(21) Appl. No.: 13/982,501

(22) PCT Filed: Feb. 21, 2012

(86) PCT No.: PCT/EP2012/000756

§ 371 (c)(1),
(2), (4) Date: Mar. 3, 2014

(87) PCT Pub. No.: WO2012/113540

PCT Pub. Date: Aug. 30, 2012

(65) Prior Publication Data

US 2014/0203115 A1 Jul. 24, 2014

(30) Foreign Application Priority Data

Feb. 21, 2011 (DE) ..... 10 2011 011 850

(51) Int. Cl.
*B05B 1/04* (2006.01)
*B05C 5/02* (2006.01)

(52) U.S. Cl.
CPC . *B05B 1/044* (2013.01); *B05B 1/04* (2013.01); *B05B 1/042* (2013.01); *B05C 5/0283* (2013.01)

(58) Field of Classification Search
CPC ..... B05B 1/04; B05B 1/042; B05B 1/044
See application file for complete search history.

(56) References Cited

U.S. PATENT DOCUMENTS 3,716,194 A * 2/1973 Miller ..... 239/318
4,128,668 A * 12/1978 Ernest ..... 427/349
4,962,891 A * 10/1990 Layden ..... 239/597
5,165,601 A * 11/1992 Rodenberger et al. ..... 239/3

(Continued)

FOREIGN PATENT DOCUMENTS

DE 102005013972 A1 10/2006
DE 102005027236 A1 12/2006

(Continued)

OTHER PUBLICATIONS

First Office Action from Chinese Patent Office for CN Application No. 201280019066.4 ;mailed May 27, 2015 (17 pages; with English translation).

*Primary Examiner* — Ryan Reis
(74) *Attorney, Agent, or Firm* — Bejin Bieneman PLC

(57) ABSTRACT

A nozzle head for emitting a spray jet of an application agent is configured such that a volumetric flow of the application agent can be applied by the spray jet, and such that the spray jet will be substantially flat and have a jet width that is a dependency of the volumetric flow of the application agent. The nozzle head comprises two outer plates and a middle plate that is disposed between the two outer plates and that includes a front edge on a spraying side of the nozzle head. The front edge of the middle plate includes a predetermined contour. The middle plate includes first and second outer tips on respective first and second sides of the middle plate, the outer tips protruding in a spraying direction. Further, the middle plate includes a recess in a middle portion of the middle plate.

22 Claims, 6 Drawing Sheets

(56) References Cited

U.S. PATENT DOCUMENTS

| | | | |
|---|---|---|---|
| 2003/0155451 | A1 | 8/2003 | Nakamura et al. |
| 2007/0042123 | A1 | 2/2007 | Endregaard et al. |
| 2010/0330292 | A1 | 12/2010 | Endregaard et al. |

FOREIGN PATENT DOCUMENTS

| | | | |
|---|---|---|---|
| DE | 102006012373 | B3 | 6/2007 |
| JP | 2000237679 | | 9/2000 |

* cited by examiner

NOZZLE HEAD FOR APPLYING AN INSULATING MATERIAL

This disclosure relates to a nozzle head for emitting a flat spray jet of an application agent, e.g., an insulating agent for insulation of motor vehicle body components.

Figure 8:
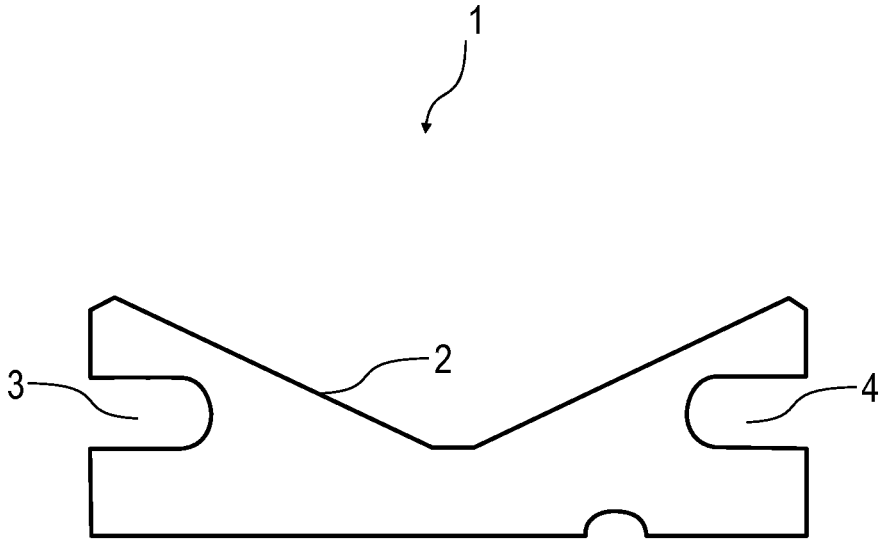
Fig. 8 Prior Art

Such a nozzle head as presently known includes two identically constructed outer plates and a thin, smaller middle plate, which is inserted between both outer plates, wherein FIG. 8 shows an exemplary embodiment of a conventional middle plate 1. The middle plate 1 has a front edge 2 on the spraying side with a substantially V-shaped contour so that a nozzle chamber is created between the neighboring outer plates and the front edge 2 of the middle plate 1 in which the insulating agent is introduced. A flat fan-shaped spray jet is formed in this way, which is well suited to the application of the insulating agent. Further, the middle plate 2 has oblong holes 3, 4 on both sides through which screws may be passed in order to screw the outer plates to the middle plate 1.

For this known nozzle head, a jet width is distance-independently almost constant in a jet plane from a certain minimum distance before the nozzle head, in as far as volumetric flow is kept constant. For example, the jet width may only fluctuates in a range of ±2 mm. This distance-independent constant jet width is advantageous for treatment of workpieces with strongly curved component surfaces since it is not necessary to keep a constant distance between the nozzle head and the surface of the component while traveling over the surface of the component. One should, however, note here that the jet width fluctuates depending on the volumetric flow of the applied insulating agent.

Reference is also made to JP 2000 237 679 A, US 2003/0155451 A1, DE 10 2005 013 972 A1 and DE 10 2005 027 236 A1 concerning the general prior art.

One disadvantage of the known spray nozzle described above is, however, that the distance-independency of the jet width is only given within a relatively narrow limited volumetric flow operating range. Outside this volumetric flow operating range, the jet width fluctuates relatively strongly depending on a distance to the nozzle head. Therefore operation is only possible in practice within the relatively narrow volumetric flow operating range.

The presently-disclosed nozzle head is generally suitable for different volumetric flows of an insulating agent, wherein the jet width should be kept constant as independently as possible of the distance to the nozzle head.

The nozzle head may be expediently formed in such a way that the volumetric flow operating range, suitable for application, with the substantially distance-independent constant jet width of the spray jet, comprises a volumetric flow range of at least ±5 $cm^3/s$, ±10 $cm^3/s$, ±15 $cm^3/s$, ±20 $cm^3/s$, ±25 $cm^3/s$, ±40 $cm^3/s$, ±80 $cm^3/s$ or ±90 $cm^3/s$. This means, for example, that the jet width of the spray jet is, from a certain minimum distance (for example, 20 mm, 30 mm, 40 mm, 50 mm, 60 mm, 70 mm, 80 mm, 90 mm or 100 mm), distance-independently substantially constant if the volumetric flow lies within the relatively wide volumetric flow operating range.

The jet width can also fluctuate for the nozzle head according depending on the volumetric flow of the applied application agent. Thus, the jet width from the minimum distance is only independent of the distance to the nozzle head, whereas the jet width can also fluctuate for the nozzle head according to the invention depending on the volumetric flow.

The jet width of the spray jet can also fluctuate for the nozzle head depending on the volumetric flow of the applied application agent. However, if the volumetric flow is kept substantially constant within the volumetric flow operating range then the jet width for the nozzle head is distance-independently substantially constant from the minimum distance.

The volumetric flow or the delivery rate can, for example, be 10 $cm^3/s$, 20 $cm^3/s$, 30 $cm^3/s$, 40 $cm^3/s$, 50 $cm^3/s$, 60 $cm^3/s$, 70 $cm^3/s$, 80 $cm^3/s$, 90 $cm^3/s$ or 100 $cm^3/s$, respectively preferably ±5 $cm^3/s$, ±10 $cm^3/s$ oder ±15 $cm^3/s$.

The jet width is generally not exactly constant for the nozzle head. Instead, the jet width can also exhibit fluctuations for the nozzle head depending on the distance to the nozzle head of, e.g., ±1 mm, ±2 mm, ±4 mm, ±6 mm, ±8 mm, ±10 mm, ±12 mm, ±14 mm or even ±16 mm. This means, for example, that, within the context of the invention, the feature "distance-independently substantially constant" can expediently include deviations of up to ±16 mm.

The nozzle head according is therefore significantly well-suited for automated application using an application robot, wherein the nozzle head is led by the application robot over the surface of the component. When programming the application robot and when using a nozzle head, one can therefore operate, on the assumption that the spray jet has a substantially constant jet width, namely for various volumetric flows of the application agent, if the volumetric flow is kept constant during application.

In an exemplary embodiment, the jet width is, from a certain minimum distance to the nozzle head, distance-independently substantially constant, e.g., with a deviation of at most ±2 mm, ±4 mm, ±6 mm, ±8 mm, ±10 mm, ±12 mm, ±14 mm or even ±16 mm, wherein the jet width is, from a certain minimum distance, only then distance-independently substantially constant if the volumetric flow of the application agent lies within a certain volumetric flow operating range and is expediently kept constant.

It is possible that the nozzle head is formed in such a way that the volumetric flow operating range with the substantially distance-independently constant jet width comprises a volumetric flow range of at least ±5 $cm^3/s$, ±10 $cm^3/s$, ±15 $cm^3/s$, ±20 $cm^3/s$, ±25 $cm^3/s$, ±40 $cm^3/s$, ±80 $cm^3/s$ oder ±90 $cm^3/s$.

In an exemplary embodiment, the nozzle head has a similar structure as the conventional nozzle head described above. The presently-disclosed nozzle head also may have-may include two outer plates and a middle plate, which is arranged between both outer plates and has on the spraying side a front edge with a prescribed contour. Thus, both outer plates may delimit, with their spraying-side front edge, a slit-shaped nozzle opening, wherein there is expediently a nozzle chamber between the outer plates and the spraying-side front edge of the middle plate in which the application agent to be applied is introduced. Advantageously, the contour of the spraying-side front edge of the middle plate is formed in such a way that the volumetric flow operating range with the substantially distance-independently constant jet width is relatively large.

Further, the front edge of the middle plate for the presently-disclosed nozzle head is not formed simply V-shaped but, instead, has a complex contour.

Thus, the spraying-side front edge of the middle plate may have on both sides outer tips, which protrude out in the spraying direction, wherein the length of the tips is preferably at least 3 mm, 4 mm or even at least 5 mm.

The tips of the middle plate may have an outer flank, which is aligned substantially parallel to the jet direction or at a right angle to the base of the middle plate. The inner flank of the tips may, in contrast, be angled at acute angle to the jet direction. For example, the inner flanks of the tips can include, with the jet direction, an angle in the range of 15°-35° wherein an angle of 24.165° or 28.3° has proven itself to be particularly advantageous. It is also possible that the inner flanks of the tips are aligned parallel to the jet direction or at right angle to the base of the middle plate.

Furthermore, the middle plate may have a recess in a middle portion thereof, which does not however extend over the whole width of the middle plate, but only over a width of, for example, at least 15 mm, 17 mm or 20 mm.

In one variant of the middle plate, the recess arranged in the middle thereof is V-shaped.

However, another variant may be used, for which the recess in the middle plate comprises a central arch section with a first radius and two adjacent outer arch sections with a second radius, wherein the second radius of the outer arch sections is greater than the first radius of the central arch section. For example the first radius of the central arch section can lie in the range of 2 mm-10 mm, wherein a value of 5 mm is preferred. The second radius of the outer arch sections of the recess, in contrast, can lie in the range of 10 mm-30 mm, wherein a value of 20 mm is preferred.

Furthermore, the middle plate has, e.g., on both sides between the outer lying tips and the central recess, respectively a straight edge area which is substantially at right angle to the spraying direction, wherein the straight edge areas, e.g., have a width of at least 3 mm, 4 mm, 5 mm or 6 mm.

The straight edge areas of the middle plate are, e.g., arranged at a height above the base of the middle plate, which is in a certain ratio to the plate height of the middle plate. Thus, the ratio of the plate height of the middle plate to the height of the straight edge areas is, e.g., in the range of 1.4-1.6, wherein a value of 1.5 is preferred.

It was established in technical trials that such forming of the spraying-side front edge of the middle plate has a positive influence on the emitted spray jet so that the latter has a substantially distance-independent constant jet width within a relatively large volumetric flow operating range.

Further, the outer plates may have spraying-side front edges for the nozzle head, which are curved in a convex manner in the spraying direction. The above-mentioned tips of the middle plate may terminate with the ends of the curved front edge of the outer plate. This means that the tips of the middle plate do not project over the outer contour of the outer plates.

Furthermore, the nozzle head according to the invention may include a plate holder for holding the outer plates and the middle plate inserted between the outer plates, wherein the plate holder may have an adjustable accommodation width in order to be in a position to accommodate plates of different thicknesses. For the plate holder of the present disclosure, the accommodation width is adjustable so that plate packages of different thicknesses can be received. This offers the advantage that middle plates of different thicknesses can be used without the thickness of the outer plates having to be adapted accordingly.

The plate holder may include two clamping plates, which are connected to each other by means of a clamping screw-connection so that the outer plates with the middle plate can be clamped in between the clamping plates. The clamping screw-connection here allows different thicknesses of the firmly clamped plate package with the outer plates and the middle plate.

Furthermore the plate holder may have a bottom plate on which both clamping plates are placed. For example, one of the both clamping plates can be fastened immovably on the bottom plate while the other clamping plate is movable by means of the clamping screw-connection in order to be able to firmly clamp the plate package of the outer plates and the middle plate. Here, the bottom plate may have a material bore hole in the area between the two clamping plates in order to supply the application agent. The plate package with the outer plates and the middle plate thus lies, in this case, above the material bore in the bottom plate, and can therefore accommodate the supplied application agent through the material bore. The material bore may have a seal (for example an O-Ring) in this case to seal off the gap between the material bore and the plate package lying thereon. It should be mentioned here that the outer plates and/or the middle plate have a material guide, which starts from the material bore in the bottom plate and opens out into the nozzle chamber between both outer plates. This material guide can, for example, include of a groove which is arranged in both outer plates and starting from the lower front edge extends in the spraying direction and reaches up to the nozzle chamber which is delimited by both outer plates and the spraying-side front edge of the middle plate.

The above-mentioned bottom plate of the plate holder may be mounted on a mounting plate, wherein the mounting plate can be moved by an application robot, for which the mounting plate is mounted, for example, on a flange plate of a robot hand axis. The connection between the bottom plate and the mounting plate takes place here via a releasable mechanical connection such as, for example, by a screw-connection.

The bottom plate can be mounted in various angular positions relative to the mounting plate. For example, an additional pin connection can be provided between the bottom plate and the mounting plate so that the bottom plate can be mounted in two different angular positions between the bottom plate and the mounting plate.

For the presently-disclosed nozzle head, the oblong holes in the middle plate or in the outer plates are preferably replaced by bore holes, which are less prone to soiling.

Further, the outer contour of the plate holder may be selected in such a way that after emerging from a water bath during cleaning of the nozzle head the water can be blown off as quickly as possible and without any great effort. Therefore, the plate holder preferably terminates sidewards substantially flush with the middle plate and the outer plates in order to avoid an interfering contour, which is prone to soiling.

Regarding the dimensions of the nozzle head according to the invention, it should be mentioned that the middle plate may have a plate thickness in the range of 0.2 mm to 0.6 mm, wherein a range of 0.4 mm to 0.5 mm is preferred.

In one exemplary embodiment, the outer plates of the nozzle head have a width of 42 mm and a height in the spraying direction of 28.8 mm. In this exemplary embodiment, the middle plate may have a width of 42 mm and a height of 19.5 mm.

The middle plate and the outer plates can, however, be scaled arbitrarily in width and/or height in order, for example, to change the spray jet width accordingly.

For example, the height of the outer plates and also of the middle plate can be reduced by a factor of 1.2, for example, for a constant width so that the outer plates have a height of 24 mm while the middle plate has a height of 16.25 mm. In this way, the jet width can be reduced for the same material flow.

In another variant, in contrast, only the width of the outer plates and the middle plate are scaled downwards with a factor of 1.2, for example, while the height of the outer plates and the middle plate remains unchanged. For example, the outer plates can have a height of 28.8 mm while the middle plate has a height of 19.5 mm.

In another exemplary embodiment, in contrast, the basic contour remains the same as for the basic version described above. In this case just the outer tips, which lead the insulating agent to the nozzle gap, are displaced to the inside in a stepless manner from an outer dimension of 42 mm until the new outer dimension of at least 35 mm is reached. Furthermore, the outer plates are shortened on the sides and the outer radius of the outer plates are displaced downwards until the outer radius again encounters the tips of the middle plate. This modification causes the jet width to be reduced somewhat for a higher delivery rate.

In another variant, in contrast, only the outer plates are modified compared to the basic version described above, in that the convex curved spraying-side front edge of the outer plates is displaced downwards so that the height of the outer plates is reduced, for example, from 28.8 mm to 24 mm.

Finally, there is yet another modification conceivable compared to the above-described last variant, wherein the outer plates can be scaled downwards in width and height in the same ratio to the width of 35 mm. The middle plate is, in contrast, only scaled in the width to 35 mm, wherein the outer tips of the middle plate are adapted to the radius of the outer plates. This modification allows realization of a delivery rate of about 45 $cm^3/s$ for a jet width of about 60 mm.

In an exemplary embodiment, the middle plate has a plate height in the jet direction, which lies in the range of 15 mm-20 mm, wherein a value of 19.5 mm is preferred. The outer plates have, in contrast, a plate height in the jet direction, which lies in the range of 25 mm-34 mm, wherein a value of 29.24 mm is preferred.

It should also be mentioned that the plate height of the middle plate may be in a certain ratio to the plate width of the middle plate, wherein this ratio may lie in the range of 0.4-0.5, wherein a value of 0.464 is preferred.

For an embodiment, it is possible that, in a range between a minimum distance to the nozzle head of about 30 mm, 40 mm or 50 mm plus at least 10 mm, 20 mm, 30 mm, 40 mm, 50 mm, 60 mm or 70 mm, the jet width fluctuates around a maximum of ±4 mm, ±6 mm, ±8 mm, ±10 mm or ±12 mm.

The nozzle head may be described as an individual component, but further a complete application robot may be used with such a nozzle head.

Further, such a nozzle head may be used for application of an insulating agent onto a vehicle body component.

Figure 1:
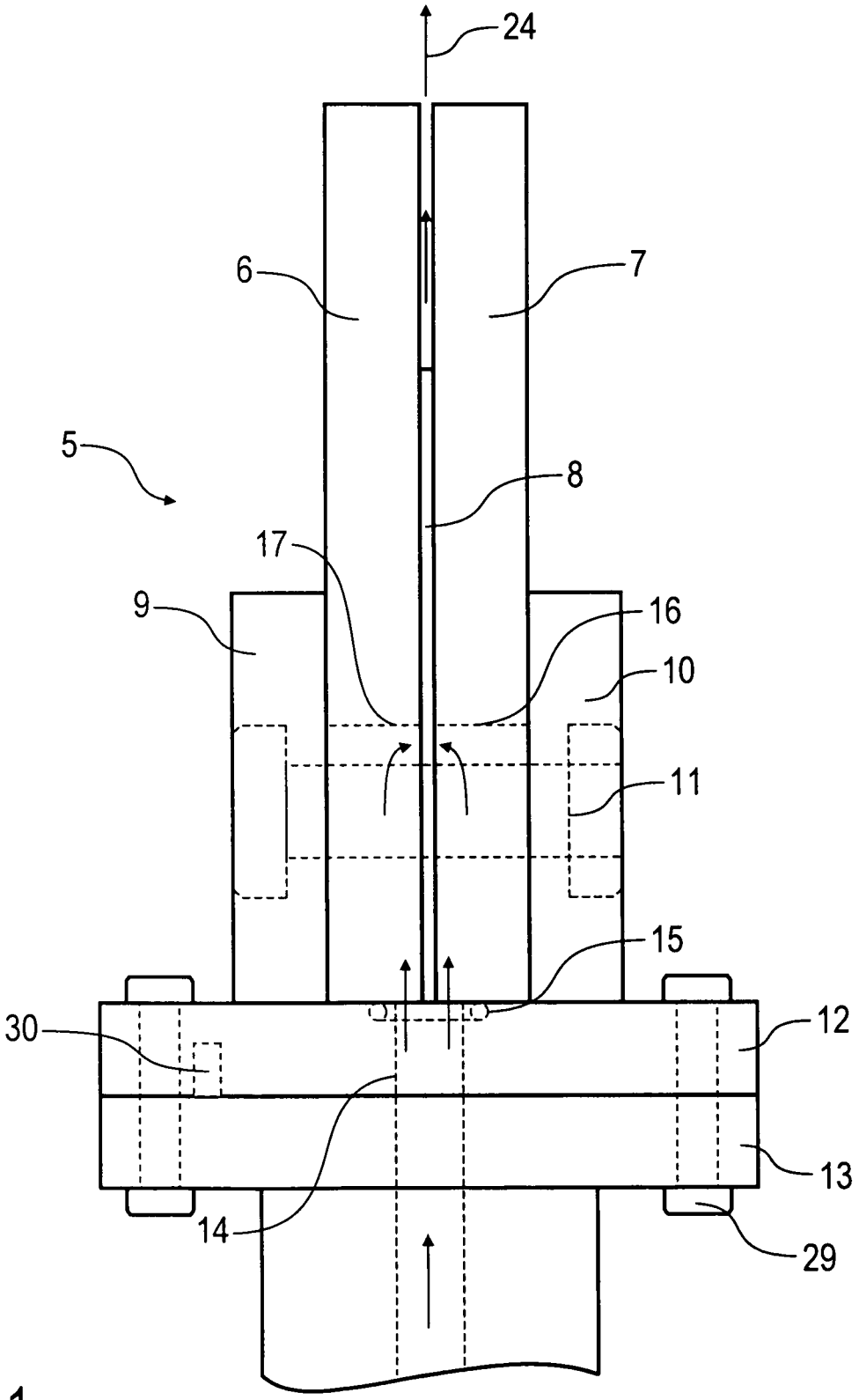
Figure 2:
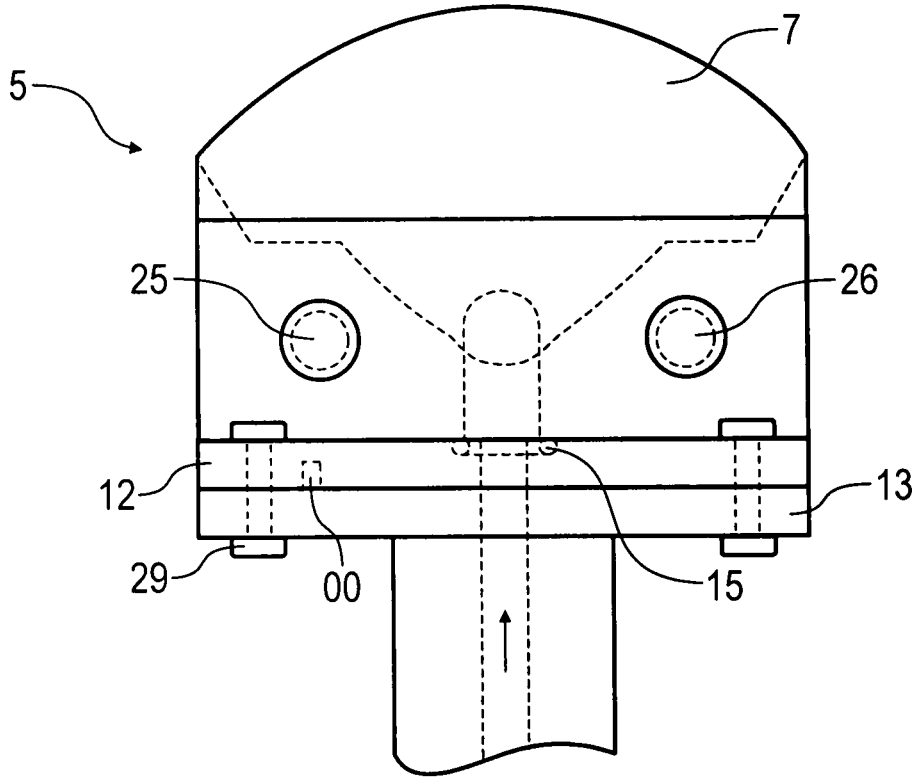
Figure 3:
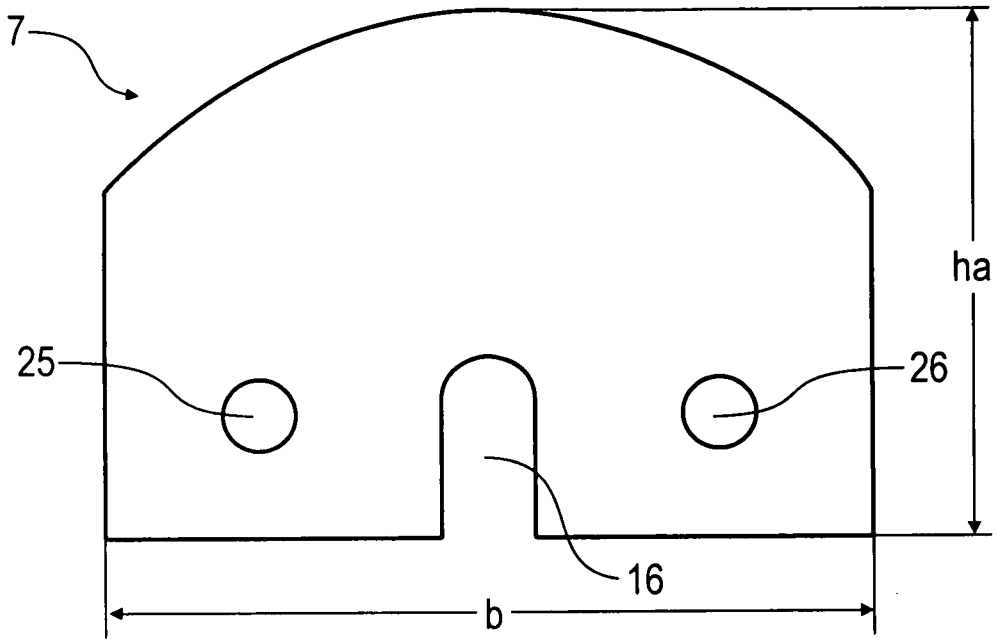
Figure 4:
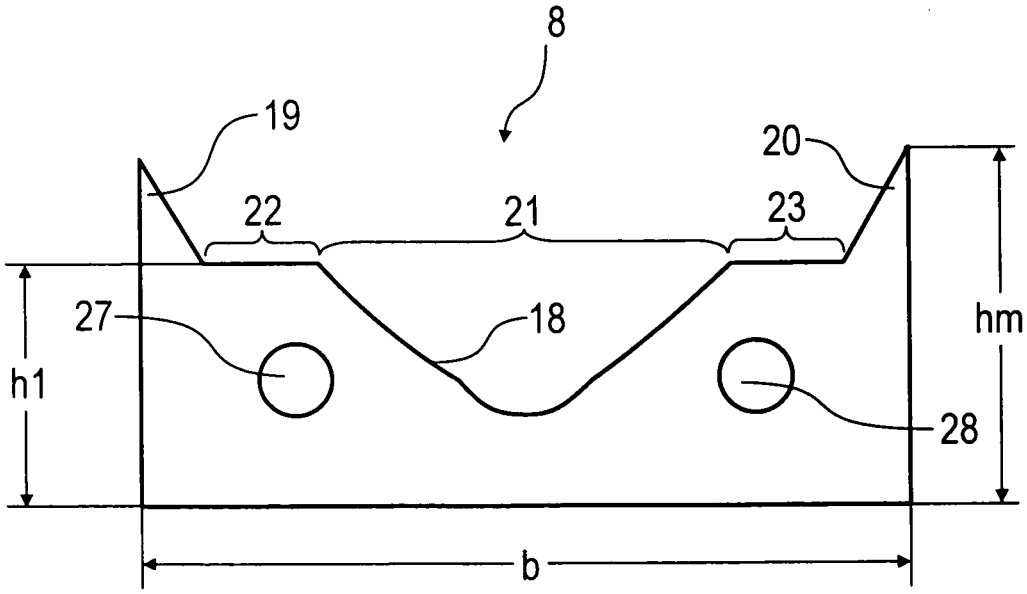
Figure 5:
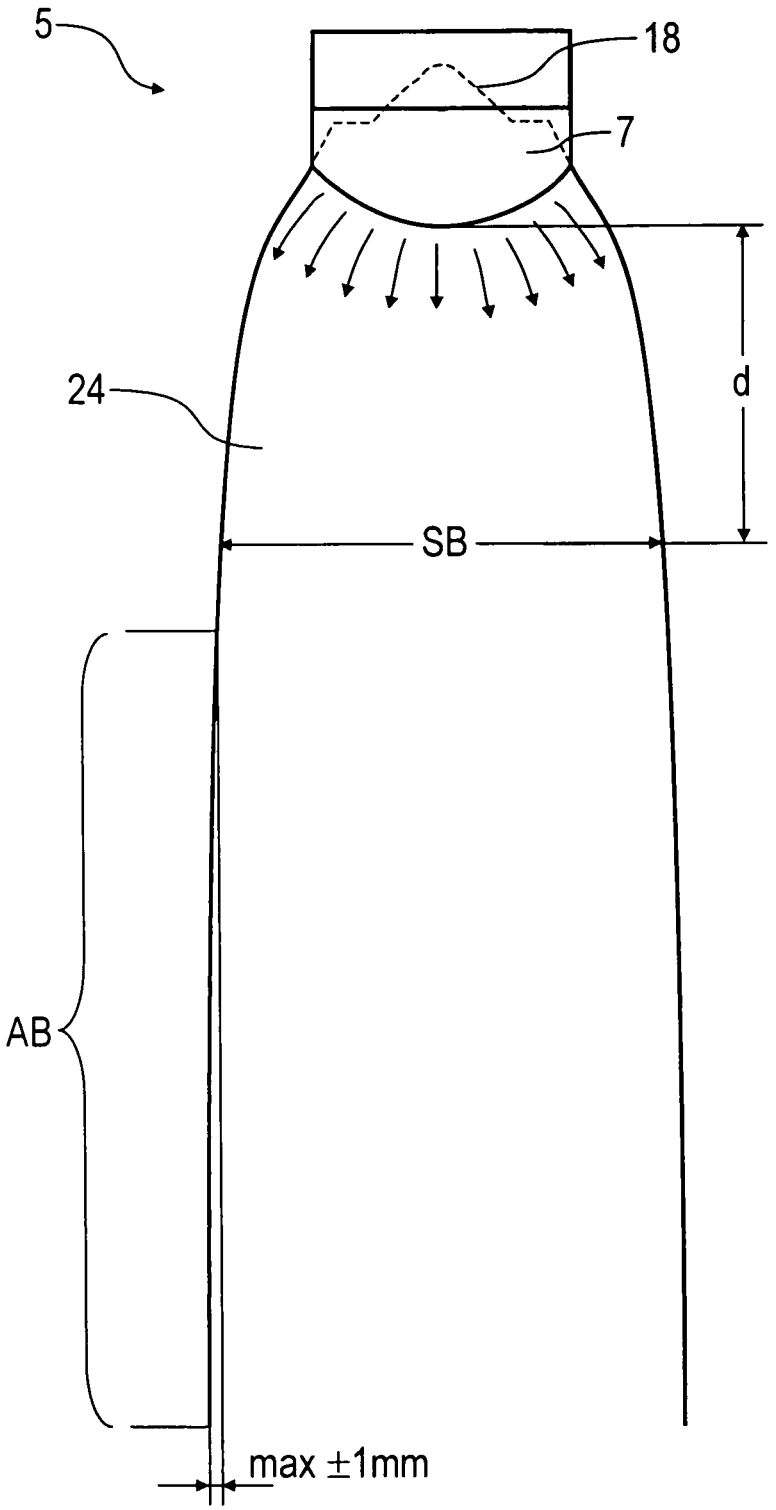
Figure 6:
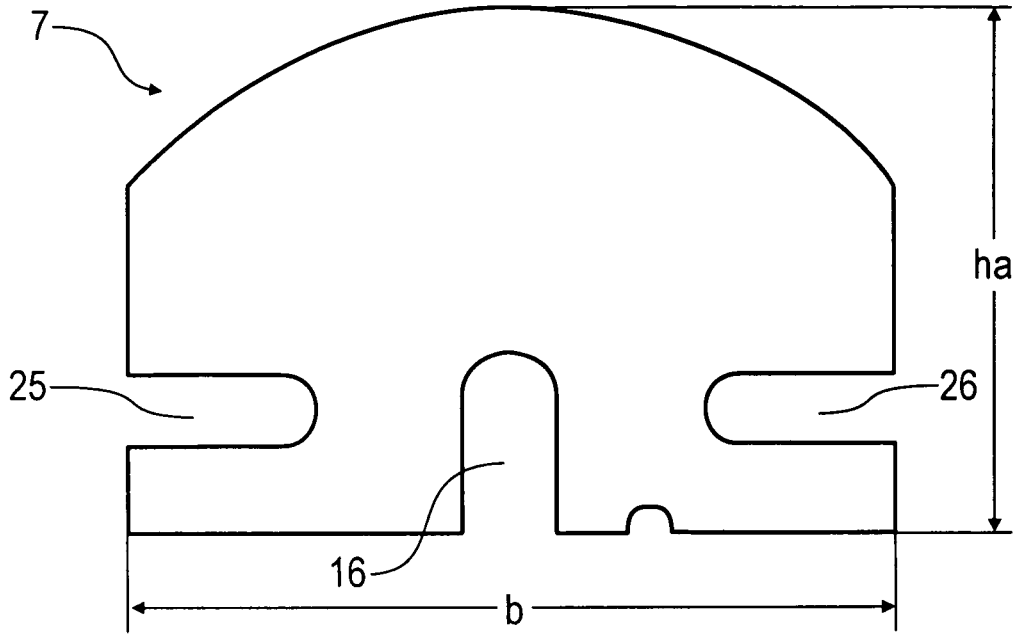
Figure 7:
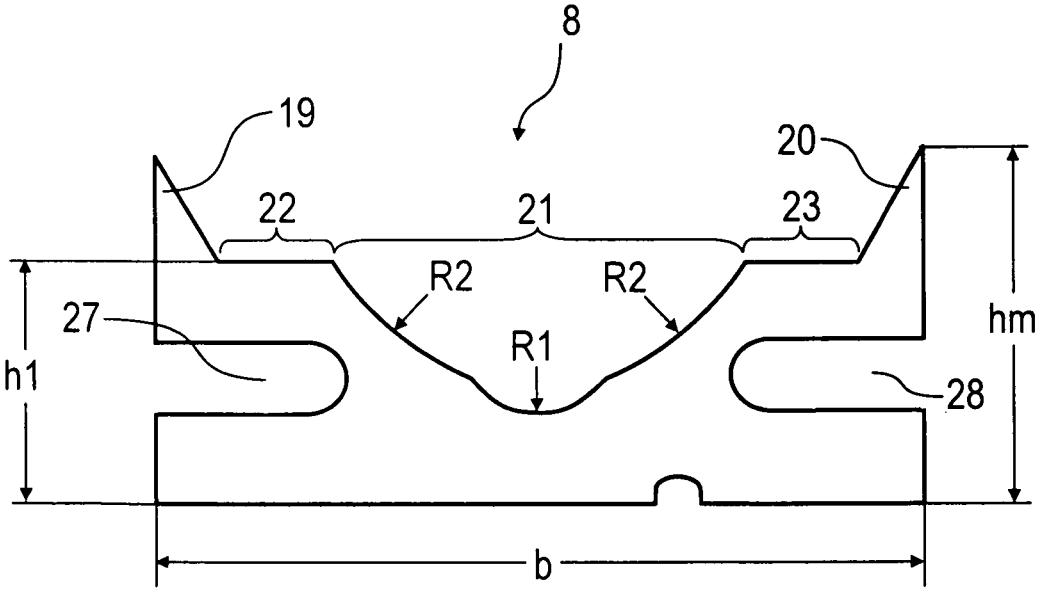

The figures show as follows:

FIG. 1: a side view of a nozzle head parallel or substantially parallel to the plane of the spray jet, FIG. 2: a front view of the nozzle head of FIG. 1 at a substantially right angle to the plane of the spray jet, FIG. 3: a front view of an outer plate of the nozzle head of FIGS. 1 and 2, FIG. 4: a front view of the middle plate of the nozzle head of FIGS. 1 to 3, FIG. 5: a schematic representation illustrating the form of the spray jet for the nozzle head, FIG. 6: a modification of the outer plate according to FIG. 3, FIG. 7: a modification of the middle plate according to FIG. 4, FIG. 8: a front view of a conventional middle plate of a nozzle head according to the prior art.

FIGS. 1 to 5 show a nozzle head 5 for application of an insulating agent (e.g. water-based acrylate) on a component, such as, for example, a motor vehicle body component.

The nozzle head 5 comprises two outer plates 6, 7, and a thin middle plate 8, which is inserted between both outer plates 6, 7, wherein the contour of the outer plates 6, 7 is shown in FIG. 3, while FIG. 4 shows the contour of the middle plate 8.

Furthermore, the nozzle head 5 comprises a plate holder to mechanically hold the plate package including the outer plates 6, 7 and the middle plate 8. This plate holder comprises two clamping plates 9, 10, which are arranged on both sides of the plate package including the outer plates 6, 7 and the middle plate 8, and can be clamped together by means of a clamping screw-connection 11 to mechanically fix the plate package. Plate packages of different thickness can be inserted between both clamping plates 9, 10 so that the thickness of the middle plate 8 can be changed in a simple way, without any necessity for the thickness of the outer plates 6, 7 to be adapted accordingly.

Furthermore, the plate holder comprises a bottom plate 12, wherein both clamping plates 9, 10 are arranged on the upper side of the bottom plate 12.

Furthermore, the plate holder comprises a mounting plate 13, which is guided by an application robot, which is only represented here schematically.

FIG. 3 furthermore shows that the outer plates 6, 7 each have a material guide 16, 17, wherein the material guide 16 and/or 17 includes a groove, which projects upwards from the lower front edge of the outer plate 6 and/or 7 in the spraying direction. The insulating agent is therefore fed over the material bore 14 and then penetrates into the material guides 16, 17, so that the insulating agent finally comes into the nozzle chamber, which is delimited on the sides by both outer plates 6, 7, and at the bottom by a front edge 18 of the middle plate 8.

Furthermore, the contour of the front edge 18 of the middle plate 8 can be seen in the detailed view in FIG. 4.

Thus, the front edge 18 of the middle plate 8 has on both sides outside respectively a tip 19 and/or 20 protruding in the spraying direction.

Furthermore the front edge 18 of the middle plate 8 centrally has an substantially V-shaped recess 21, wherein the V-shaped recess 21 does not extend over the whole width b of the middle plate 8.

Finally, the outer contour of the front edge 18 of the middle plate 8 comprises on both sides of the V-shaped recess 21 respectively a straight edge area 22, 23, wherein the straight edge areas 22, 23 are aligned at right angle to the spraying direction.

The above-described contour of the front edge 18 of the middle plate 8 has the advantage that the nozzle head 5 has a spray jet 24 with a substantially constant jet width SB, as can be seen in particular in FIG. 5. The jet width SB of the spray jet 24 depends on a distance d to the nozzle head 5. Within a relatively large operating range AB, the jet width SB fluctuates, however, by a maximum of ±2 mm and is thus substantially constant, if the volumetric flow of the applied insulating agent is kept constant during the application.

The outer plates 6, 7 may have a height of ha=28.8 mm, while the middle plate 8 has a height of hm=19.5 mm.

The outer plates 6, 7, as well as the middle plate 8, have, however, a uniform width of b=42 mm.

The middle plate 8 terminates, together with the outer plates 7 in the plate holder, flush with the outer contour of the plate holder, whereby an interfering contour which is prone to soiling is avoided.

Furthermore, the outer plates 6, 7, and the middle plate 8, each have bores 25-28 instead of the oblong holes 3, 4 known from the prior art shown in FIG. 8, which are less prone to soiling than the conventional oblong holes 3, 4. The bores 25-28 serve here for passing the clamping screw-connection 11 through.

FIGS. 1 and 2 furthermore show that the bottom plate 12 can be connected by a screw connection with the mounting plate 13. Here, the bottom plate 12 can be mounted on the mounting plate 13 in two different, orthogonal to each other, aligned angular positions. An additional pin connection 30 is provided to define these two angular positions, which restricts the plate 13 to the desired angular positions. The pin connection 30 can, for example, include a pin on the upper side of the mounting plate 13 and two suitable bores in the underside of the bottom plate 12, wherein the pin can selectively be introduced into one of the both bores.

FIG. 6 shows a modification of the middle plate 7 according to FIG. 3, wherein the modification widely conforms with the exemplary embodiment described above according to FIG. 3, such that, to avoid repetition, reference is made to the above description, wherein the same reference signs are used for corresponding details.

One particularity of this exemplary embodiment is that the bores 25, 26 in the outer plate 7 are formed as sidewards open oblong holes.

Further, the outer plate 7 may have a width b=42 mm and a height ha=29.24 mm.

FIG. 7 shows a modification of the middle plate 8 according to FIG. 4, such that, to avoid repetition, reference is made to the above description, wherein the same reference signs are used for corresponding details.

A particularity of this modification is, in turn, that sidewards open oblong holes are provided instead of the bores 27, 28.

A further particularity of this exemplary embodiment is that the recess 21 in the middle plate 8 is not V-shaped but rather comprises a central arch section R1 and two adjacent outer arch sections R2, wherein the outer arch sections R2 have a radius of 20 mm while the central arch section R1 has a radius of 5 mm.

Further, the tips 19, 20 each have here outer flanks, which are aligned parallel to the jet direction.

The inner flanks of both tips 19, 20 are, in contrast, at an angle of 28.3° acute-angled to the jet direction.

The invention is limited only by the following claims, and is not limited to the previously described preferred exemplary embodiments. Instead, a plurality of variants and modifications is possible, which also make use of the concept of the invention and therefore fall within the scope of protection.

The invention claimed is:

1. A nozzle head for emitting a spray jet of an application agent, configured such that a volumetric flow of the application agent can be applied by the spray jet, and such that the spray jet will be substantially flat and have a jet width that is a dependency of the volumetric flow of the application agent, the nozzle head comprising:

two outer plates; and a middle plate that is disposed between the two outer plates and that includes a front edge on a spraying side of the nozzle head;

wherein:

the front edge includes first and second outer tips on respective first and second sides of the middle plate, the outer tips protruding in a spraying direction, a recess in a middle portion of the front edge that is substantially v-shaped, and a first straight edge area between the first outer tip and the recess aligned at a substantially right angle to the spraying direction, and a second straight edge area between the second outer tip and the recess aligned at a substantially right angle to the spraying direction.

2. The nozzle head according to claim 1, wherein the jet width is substantially constant at a certain minimum distance from the nozzle head when the volumetric flow of the application agent is within a specific volumetric flow operating range and is kept substantially constant.

3. The nozzle head according to claim 2, wherein the volumetric flow operating range is at least ±10 $cm^3/s$.

4. The nozzle head according to claim 2, wherein the maximum deviation of the jet width is substantially ±2 mm.

5. The nozzle head according to claim 1, further comprising:

a slit-shaped nozzle opening that is delimited by spraying-side front edges of the two outer plates; and a nozzle chamber between the spraying-side front edge of the middle plate and the two outer plates;

wherein the front edge of the middle plate is formed in such a way that the volumetric flow operating range is at least ±10 $cm^3/s$.

6. The nozzle head according to claim 2, wherein:

the volumetric flow operating range is between 10 $cm^3/s$ to 200 $cm^3/s$, and the minimum distance to the nozzle head is at least 10 mm.

7. The nozzle head according to claim 1, further comprising:

the outer tips having a length of at least 3 mm;

the outer tips having an outer flank that extends substantially parallel to the spraying direction;

the outer tips having inner flanks that each include an angle of at least 15° with respect to the spraying direction;

the outer tips having inner flanks that each include an angle of at most 35°;

the recess having, at a substantially right angle to the spraying direction, a width of at least 15 mm;

the straight edge areas each having a width of at least 3 mm.

8. The nozzle head according to claim 1, wherein:

the recess includes a central arch section with a first radius, and two adjacent outer arch sections with a second radius; and the second radius of the outer arch sections is greater than the first radius of the central arch section.

9. The nozzle head according to claim 8, wherein:

the first radius of the central arch section is larger than 2 mm;

the first radius of the central arch section is smaller than 10 mm;

the second radius of the outer arch sections is larger than 10 mm; and the second radius of the outer arch sections is smaller than 30 mm.

10. The nozzle head according to claim 8, wherein the first radius of the central arch section is substantially 5 mm, and the second radius of the outer arch sections is substantially 20 mm.

11. The nozzle head according to claim 1, wherein:

the outer plates each include a front edge on the spraying side, the front edge being curved in a convex manner in the spraying direction; and each of the outer tips terminates with the ends of the curved front edge of the outer plates.

12. The nozzle head according to claim 7, wherein:

the straight edge areas are arranged at a first height above a base of the middle plate;

the middle plate has a plate height in the spraying direction; and a ratio between the plate height and the first height is in the range of 1.4 to 1.6.

13. The nozzle head according to claim 1, wherein:

the nozzle head includes a plate holder configured to hold the outer plates and the middle plate; and the plate holder includes an adjustable accommodation width configured to allow accommodation of plates with different thicknesses.

14. The nozzle head according to claim 13, wherein the plate holder has two clamping plates that are connected with each other by a clamping screw-connection such that the outer plates and the middle plate can be clamped between the clamping plates.

15. The nozzle head according to claim 14, wherein:

the plate holder includes a bottom plate onto which both clamping plates are placed;

the bottom plate includes a material bore between the two clamping plates to thereby supply the application agent;

the material bore is provided with a seal; and a material guide is arranged in at least one of the outer plates and the middle plate, the material guide originating from the material bore in the bottom plate and opening into the nozzle chamber between the two outer plates.

16. The nozzle head according to claim 13, wherein:

the plate holder includes a bottom plate that carries the outer plates and the middle plate;

the plate holder carries a mounting plate configured to allow mounting of the nozzle head on a robot;

the bottom plate is attached by a releasable mechanical connection to the mounting plate; and the bottom plate can be mounted in different angular positions relative to the mounting plate.

17. The nozzle head according to claim 16, further comprising:

a form-fitting connection between the bottom plate and the mounting plate;

wherein the form-fitting connection is configured to allow two different angular positions between the bottom plate and the mounting plate.

18. The nozzle head according to claim 17, wherein the form-fitting connection is one of a pin connection and a tongue-and-groove connection.

19. The nozzle head according to claim 13, wherein at least one of the middle plate and the outer plate includes at least one bore configured for mounting in the plate holder, thereby avoiding an elongated hole prone to soiling.

20. The nozzle head according to claim 13, wherein the plate holder terminates at a side substantially flush with the middle plate and the outer plates, whereby the nozzle head is configured to prevent an interfering contour prone to soiling.

21. The nozzle head according to claim 1, comprising at least one of the following features:

the middle plate has a plate thickness of at least 0.2 mm;

the middle plate has a plate thickness of at most 0.6 mm;

the middle plate has a plate height in the spraying direction of at least 15 mm, and of at most 24 mm;

the outer plates have a plate height in the jet spraying direction of at least 25 mm, and of at most 30 mm;

the middle plate has a plate width and a plate height in the spraying direction, wherein a ratio between the plate height and the plate width is substantially in the range of 0.4 to 0.5.

22. The nozzle head according to claim 1, wherein the application agent is an insulating agent.

* * * * *

UNITED STATES PATENT AND TRADEMARK OFFICE

CERTIFICATE OF CORRECTION

PATENT NO. : 9,381,526 B2
APPLICATION NO. : 13/982501
DATED : July 5, 2016
INVENTOR(S) : Bernd Kraft et al.

It is certified that error appears in the above-identified patent and that said Letters Patent is hereby corrected as shown below:

In the claims:

Column 10, in line 23, replace “in the jet spraying” with -- in the spraying --.

Signed and Sealed this
Twenty-third Day of August, 2016

Michelle K. Lee

Michelle K. Lee
*Director of the United States Patent and Trademark Office*